US007275771B2

(12) United States Patent
Crotti et al.

(10) Patent No.: US 7,275,771 B2
(45) Date of Patent: Oct. 2, 2007

(54) LOCK FOR A DOOR OF A MOTOR VEHICLE

(75) Inventors: Giacomo Crotti, Pisa (IT); Franco Giovanni Ottino, San Giuliano Terme (IT)

(73) Assignee: Intier Automotive Closures S.p.A., Cascine Vica Rivoli (IT)

( * ) Notice: Subject to any disclaimer, the term of this patent is extended or adjusted under 35 U.S.C. 154(b) by 103 days.

(21) Appl. No.: 10/517,953

(22) PCT Filed: Jun. 13, 2003

(86) PCT No.: PCT/IT03/00371

§ 371 (c)(1),
(2), (4) Date: Jul. 11, 2005

(87) PCT Pub. No.: WO03/106791

PCT Pub. Date: Dec. 24, 2003

(65) Prior Publication Data

US 2006/0163884 A1 Jul. 27, 2006

(30) Foreign Application Priority Data

Jun. 14, 2002 (TO) ..... 2002A000510

(51) Int. Cl.
*E05C 3/16* (2006.01)
*E05C 3/06* (2006.01)

(52) U.S. Cl. ..... 292/216; 292/201; 292/DIG. 23

(58) Field of Classification Search ..... 292/201, 292/DIG. 23, DIG. 27, DIG. 65, 280, 336.3, 292/237, 216; 49/280; 70/277, 278.2, 278.7
See application file for complete search history.

(56) References Cited

U.S. PATENT DOCUMENTS

| | | | | |
|---|---|---|---|---|
| 5,538,298 | A * | 7/1996 | Ikeda | 292/201 |
| 5,666,834 | A | 9/1997 | Inoue | |
| 5,722,272 | A * | 3/1998 | Bridgeman et al. | 70/264 |
| 5,746,076 | A | 5/1998 | Inoue | |
| 5,855,130 | A | 1/1999 | Rohrbacher et al. | |
| 5,921,594 | A | 7/1999 | Bendel | |
| 6,102,453 | A * | 8/2000 | Cetnar | 292/201 |
| 6,109,079 | A * | 8/2000 | Ikeda | 70/264 |
| 6,364,378 | B1 | 4/2002 | Humbert et al. | |
| 6,463,773 | B1 * | 10/2002 | Dimig | 70/277 |
| 6,764,113 | B1 * | 7/2004 | Cetnar | 292/201 |
| 2001/0035654 | A1 | 11/2001 | Cetnar et al. | |

FOREIGN PATENT DOCUMENTS

EP 1 138 854 10/2001

* cited by examiner

*Primary Examiner*—Brian E. Glessner
*Assistant Examiner*—Alyson Merlino
(74) *Attorney, Agent, or Firm*—Clark Hill P.L.C.

(57) ABSTRACT

A lock for a door of a motor vehicle is provided having: a closing mechanism designed for coupling with a lock striker for bringing about closing of the door; mechanical opening means for controlling release of the closing mechanism from the lock striker; mechanical means for inhibiting opening which can be selectively activated for rendering the opening means ineffective; and electrical actuator means housed in a fluid-tight way in a single casing having at least one output member which traverses, in a fluid-tight way, a through hole of the casing to interact with the means for inhibiting opening.

14 Claims, 8 Drawing Sheets

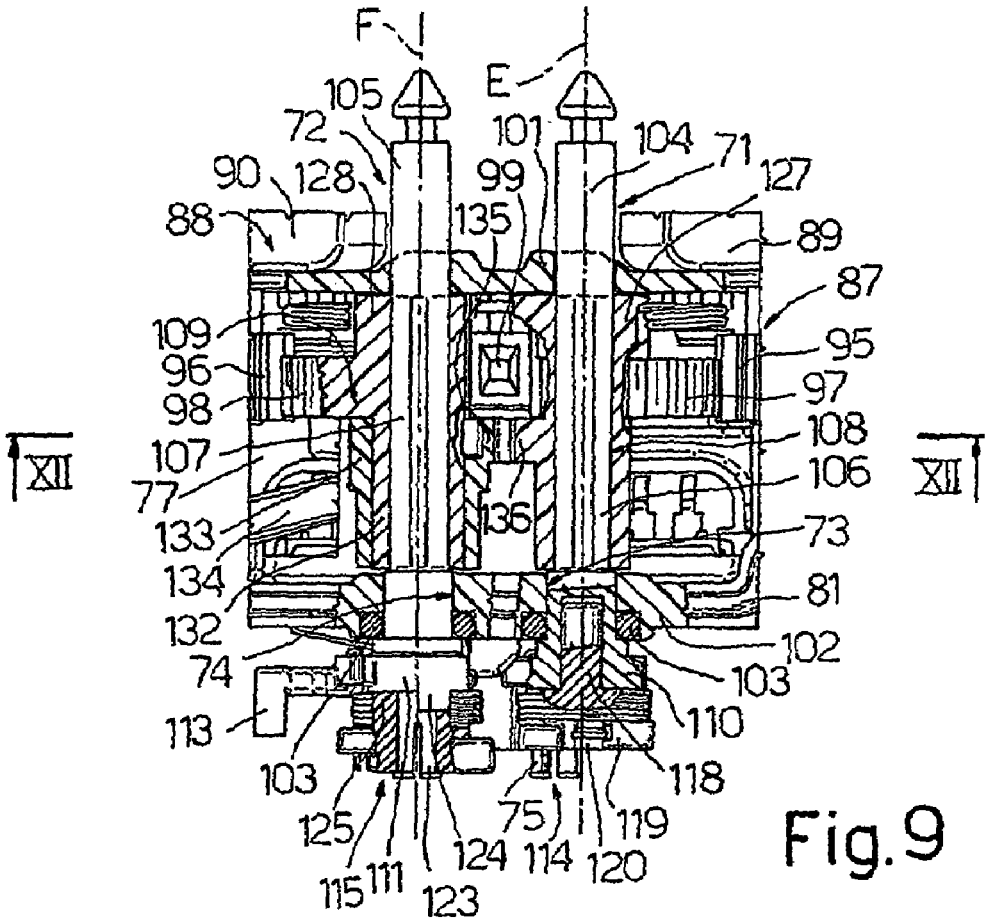
Fig.9
Fig.8
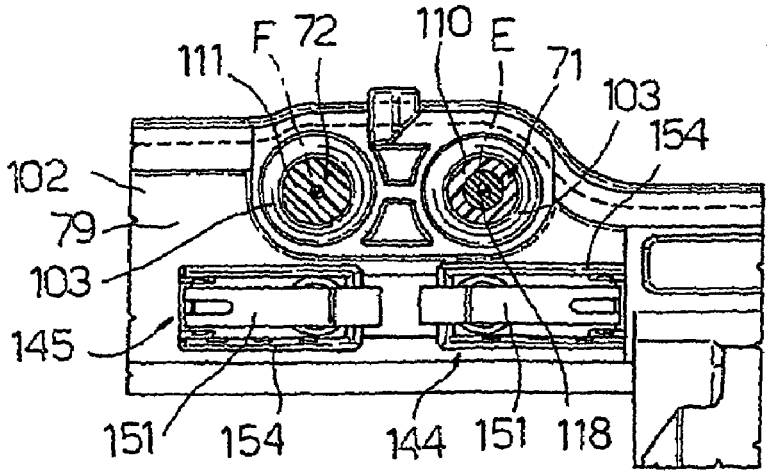

LOCK FOR A DOOR OF A MOTOR VEHICLE

TECHNICAL FIELD

The present invention relates to a lock for a door of a motor vehicle.

BACKGROUND ART

As is known, the doors of motor vehicles generally comprise a top frame portion, which defines a window closed by a moving glass, when raised, and a box-like bottom portion formed by an external panel and an internal panel joined together, at one end, by an end edge and defining between them a compartment, in which there are commonly housed the glass of the window, when this is lowered, and various components fixed to the panels themselves, amongst which, for example, a lock. Frequently, the compartment in the door is divided, by an intermediate diaphragm that is impermeable to water, into a more internal dry region, delimited by the internal panel, and a more external damp region, i.e., a region that is subject to water and to atmospheric humidity, delimited by the outer panel and generally housing the glass of the window, when this is lowered.

In order to be able to interact with a lock striker fixed to a fixed upright of the door, traditional locks are generally mounted inside the damp region of the compartment of the door.

In particular, as is known, traditional locks basically comprise a closing mechanism, designed to couple, in a releasable way, with the lock striker in order to bring about closing of the door, and a mechanical actuating assembly designed to be connected to the manual-control elements associated to the door of the motor vehicle, such as, for instance, an internal handle and an external handle and designed for interacting with the closing mechanism for controlling opening thereof.

More precisely, the mechanical actuating assembly generally comprises: an opening assembly, which can be connected to the internal handle and to the external handle and is designed for interacting with the closing mechanism to bring about its release from the lock striker; a main safety device, which is available in one first and one second configuration, respectively for enabling and disabling opening of the closing mechanism from outside the motor vehicle (i.e., external-safety function activated and deactivated, respectively); and an auxiliary safety device, which can be activated selectively for disabling opening of the closing mechanism from inside the motor vehicle and thus obtain an internal-safety function, commonly known as "dead lock".

Locks of the aforesaid type are known, which moreover comprise two or more electrical actuators, for example for controlling opening of the closing mechanism and for activating and deactivating the external-safety and internal-safety functions.

In order to obtain the said functions, it is obviously necessary for the lock to be equipped with electrical components for signalling and control, for instance, microswitches, as well as electrical-connection components.

Since, as has been pointed out previously, in order to be able to interact with the lock striker, the locks described are normally positioned inside the damp region of the compartment in the door, it is necessary to adopt a whole series of precautions in order to prevent contact of the locks with water from possibly jeopardizing their operation, such as, for example, the use of water-tight electrical components and actuators, which are decidedly more costly than similar components and actuators for which impermeability to water is not required.

SUMMARY OF THE INVENTION

A purpose of the present invention is to provide a lock for a door of a motor vehicle, which will enable the drawback referred to above to be overcome in a simple and inexpensive way.

A further purpose of the present invention is to provide a lock for a door of a motor vehicle, which will be easy to adapt for implementation of a large number of functions, without this entailing major structural modifications.

According to the present invention, a lock is provided for a door of a motor vehicle. The lock includes a closing mechanism that is designed for coupling, in a releasable way, with a lock striker for bringing about closing of the door. The closing mechanism includes a mechanical actuating assembly that has an opening means for controlling release of the closing mechanism from the lock striker and a means for inhibiting opening, which in turn includes a first safety member and a second safety member that can be selectively activated for rendering the opening means ineffective from outside and inside the motor vehicle, respectively. The lock also includes an electric-actuator means that includes a first output member coupled with the first safety member. The electric-actuator means is housed in a fluid-tight way in a single casing and the first output member traverses, in a fluid-tight way, a through hole of the casing for co-operating with the first safety member. The electric-actuator means also includes a second output member coupled with the second safety member. The second output member traverses, in a fluid-tight way, a further through hole of the casing. The casing defines an area for housing a manual control device of the first output member and an additional electrical control device of the second output member, which provides a function of child safety of the lock.

BRIEF DESCRIPTION OF THE DRAWINGS

For a better understanding of the present invention, there follows a description of a preferred embodiment, provided purely by way of non-limiting example, and with reference to the attached drawings, in which:

FIG. 8 is a cross-sectional view according to the line VIII-VIII of FIG. 7;

FIG. 9 is top plan view, in partial cross section and at an enlarged scale, of the electric-actuator assembly illustrated in FIG. 7;

BEST MODE FOR CARRYING OUT THE INVENTION DETAILED DESCRIPTION OF THE PREFERRED EMBODIMENT

Figure 1:
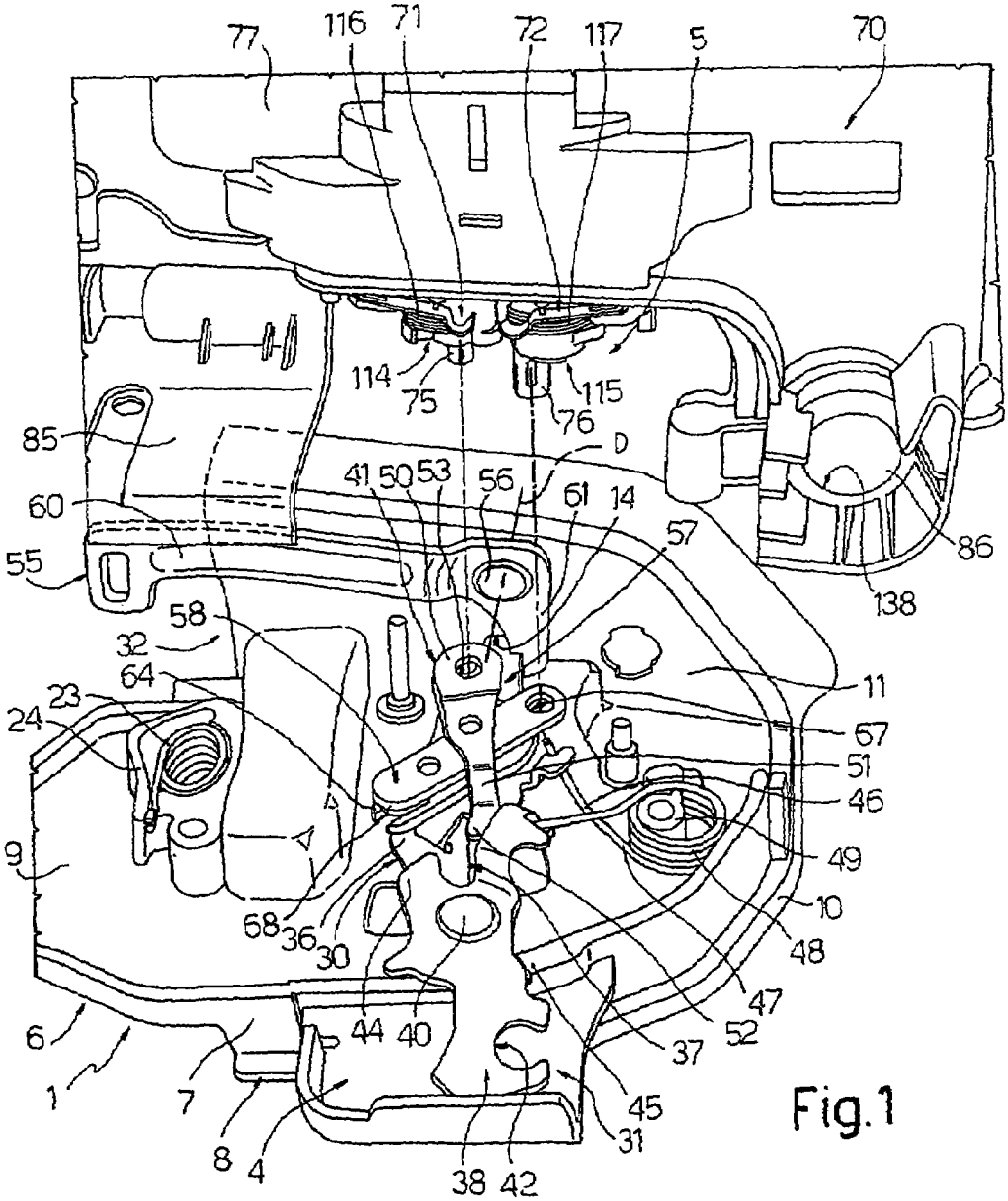
FIG. 1 illustrates, in an exploded perspective view and with parts removed for reasons of clarity, a lock built according to the present invention.
Figure 2:
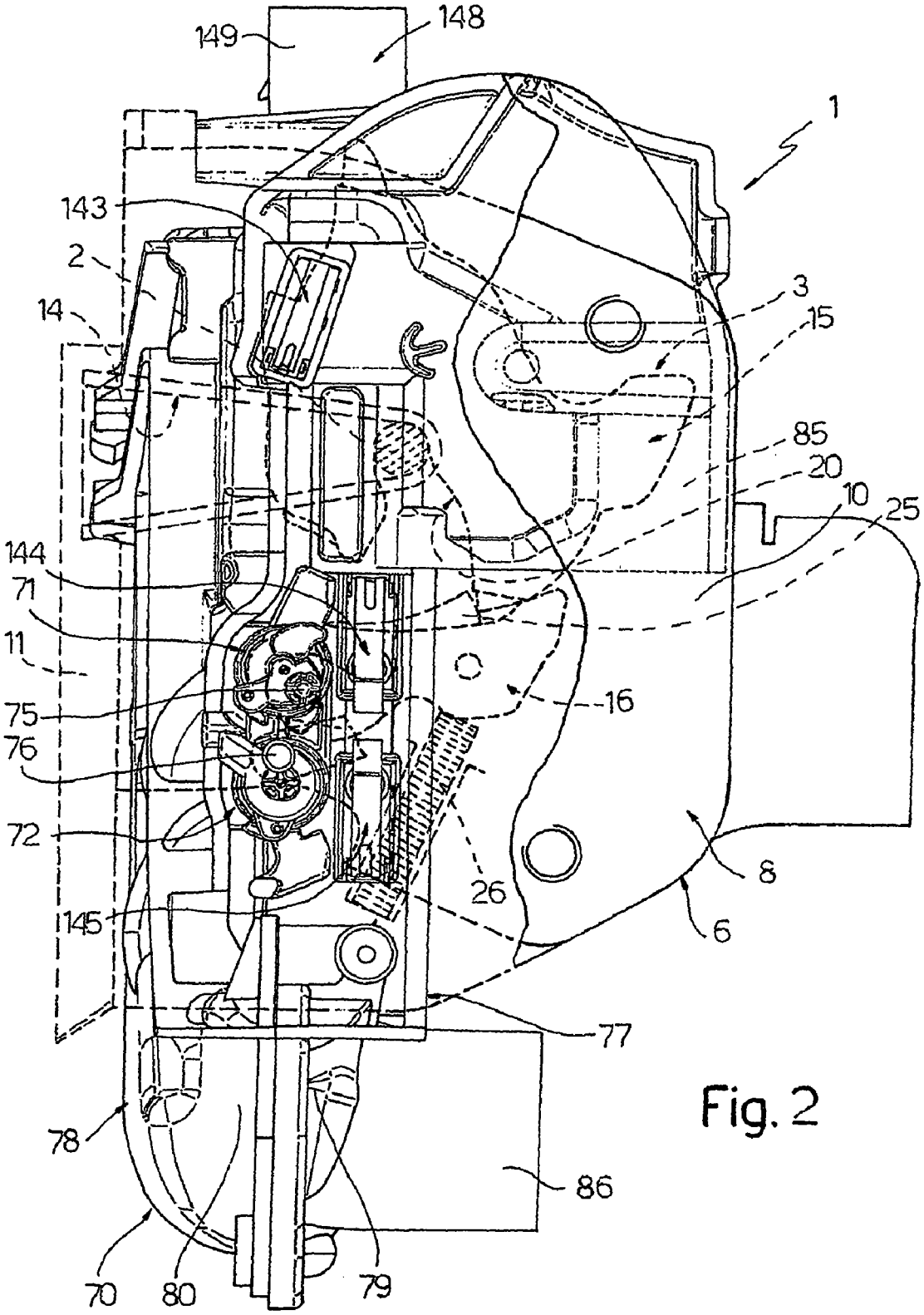
FIG. 2 is a side view of the lock illustrated in FIG. 1, with parts removed for reasons of clarity.

With reference to FIGS. 1 and 2, the number 1 designates, as a whole, a lock for a door (not illustrated) of a motor vehicle (not illustrated either), in the case in point, a lock suitable for being mounted on a front door, driver's side, of the motor vehicle.

The lock 1 is designed for interacting, in a known way, with a lock striker 2 (FIG. 2) fixed to an upright (not illustrated) of the door, and forms part of a centralized closing system for closing the doors of the motor vehicle, the operation of which is managed in a known way (not illustrated herein) by the electrical system of the motor vehicle.

The lock 1 basically comprises: a closing mechanism 3 (FIG. 3, dashed line) designed for coupling, in a releasable way, with the lock striker 2 for bringing about closing of the door; a mechanical actuating assembly 4 designed for being connected to manual-control elements associated to the door of the motor vehicle, such as, for example, internal and external handles (not illustrated) and designed for interacting with the closing mechanism 3 for controlling release thereof from the lock striker 2; and an electric-actuator assembly 5 for controlling the mechanical actuating assembly 4.

The closing mechanism 3 and mechanical actuating assembly 4 are mounted on a single supporting body 6, designed for being rigidly fixed to the door of the motor vehicle.

In particular, the supporting body 6 has a sandwich structure and is made up of an intermediate shell 7, which is made of plastic material and has a prismatic shape, and a pair of basic metal plates 8, 9 mounted, on opposite sides, on the shell 7.

More precisely, one of the plates 8 is made up of two portions 10, 11 set at right angles with respect to one another, whilst the other plate 9 extends on a single plane of lie parallel to the portion 10 and bears upon the portion 11 by butting against it.

As may be seen in FIG. 1, the portion 11 of the plate 8 projects beyond the plate 9.

The shell 7 and the plates 8, 9 delimit between them a compartment or cavity for housing the closing mechanism 3; the mechanical actuating assembly 4 is, instead, set outside said cavity and is supported by the plate 9 and by the portion 11 of the plate 8 contiguous thereto.

In order to enable introduction of the lock striker 2 inside the cavity of the supporting body 6 so that it can interact with the closing mechanism 3, the shell 7 and the plate 8 are provided with respective openings 13, 14, which are aligned with respect to one another. More precisely, the opening 13 of the shell 7 (FIG. 3) basically has a C-shaped conformation open towards the outside of the supporting body 6, whereas the opening 14 has a closed elongated profile, extends on both of the portions 10, 11 of the plate 8 and presents, along the portion 10 itself, a conformation identical to that of the opening 13.

The closing mechanism 3 comprises, in a known way, a fork 15 and a pawl 16 hinged to respective pins 17, 18, which extend between the portion 10 of the plate 8 and the plate 9. The pins 17, 18 are rigidly fixed to the supporting body 6 and have respective axes A, B orthogonal to the portion 10 of the plate 8 and to the plate 9.

The fork 15 is formed by a shaped metal plate coated with plastic material, is hinged at one intermediate portion thereof to the pin 17, and has a C-shaped peripheral seat 20, which is designed for receiving the lock striker 2 and is delimited laterally by a pair of teeth 21, 22.

The fork 15 is pushed, in a known way, by the action of return of a cylindrical helical spring 23, which is wound around the pin 17 and constrained to the fork 15 (in a way that is not visible) and to an appendage 24 of the plate 9. In particular, the fork 15 is pushed by the spring 23 in the direction of an opening position (not illustrated), in which it is set laterally so that it bears, with its own tooth 21, upon a contrast element or detent (not visible) of the shell 7, which is located on one side of the opening 13 and enables engagement and disengagement of the lock striker 2 within/from its own seat 20.

Under the thrust of the lock striker 2 and following upon slamming of the door, the fork 15 rotates about the axis A from the opening position to a closing position (FIG. 3), in which the lock striker 2 is blocked in its own seat 20, and the tooth 21 intercepts, in a known way, the openings 13 and 14, preventing the lock striker 2 from coming out.

The pawl 16 is formed by a shaped metal plate coated with plastic material, which extends on the same plane of lie as the fork 15 and on one side of the latter. The pawl 16 has an L-shaped lateral projection 25, which is designed for snap-action coupling with the tooth 22 of the fork 15 so as to block the fork 15, in a releasable way, in the closing position.

The pawl 16 is pushed, in a known way, in the direction of the fork 15 by a cylindrical helical spring 26, which acts against one side of the pawl 16 opposite to the side from which the projection 25 extends.

The pawl 16 further carries, in cantilever fashion, an actuating projection 27, which extends parallel to the axes A and B and engages a through slot 28 of the plate 9 in order to receive opening forces from the mechanical actuating assembly 4, as will be described in greater detail in what follows.

Figure 3:
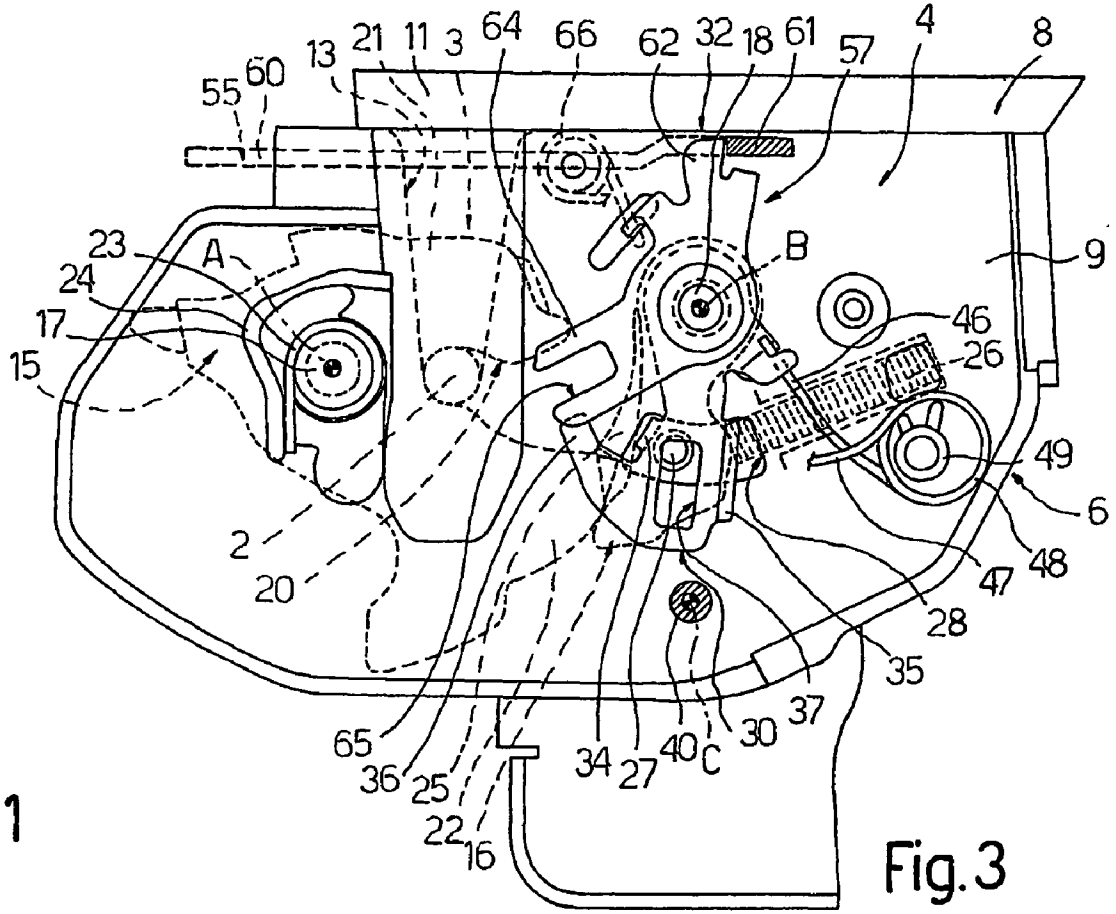
FIGS. 3 and 4 are top plan views, in partial cross section according to parallel planes, of a mechanical actuating assembly of the lock illustrated in FIG. 1.
Figure 4:
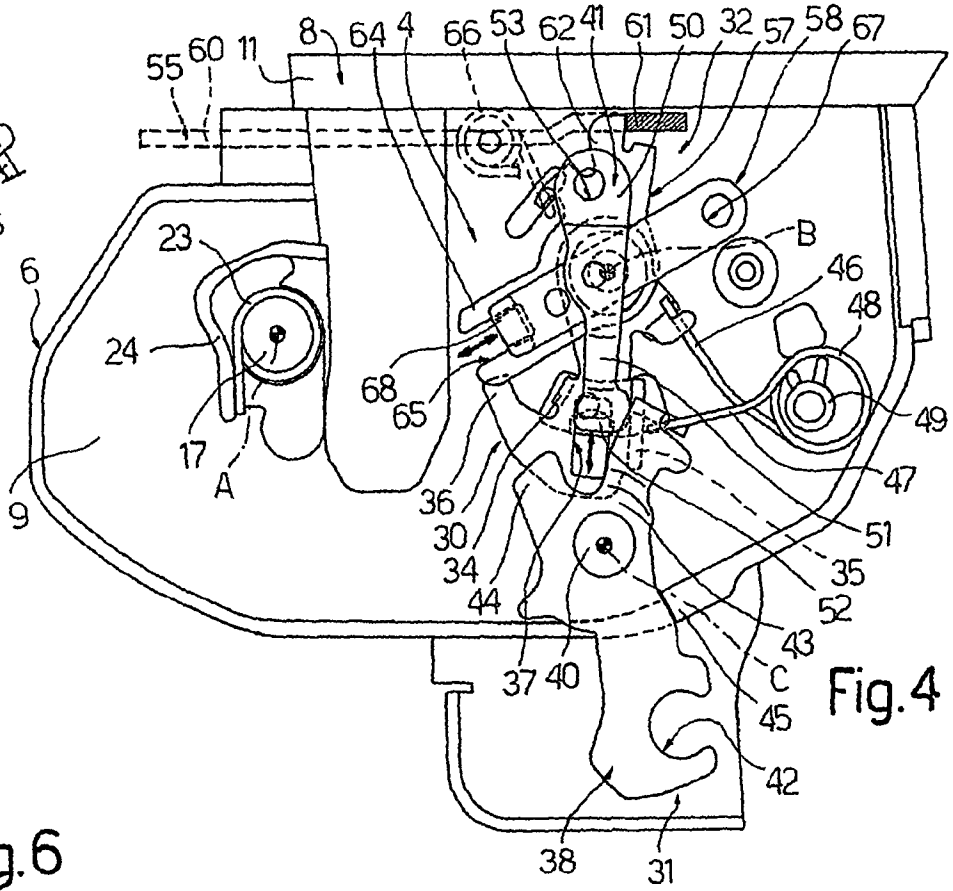

With reference to FIGS. 1, 3 and 4, the mechanical actuating assembly 4 comprises an opening lever 30, which interacts with the projection 27 of the pawl 16 in order to uncouple the pawl 16 from the fork 15, and a pair of actuating mechanisms 31, 32, which can be connected, in a known way, to an external handle and to an internal handle, respectively, of the door (the said handles not being illustrated) and which co-operate selectively with the opening lever 30 in order to open the lock 1 from outside and, respectively, from inside the motor vehicle.

The opening lever 30, which is preferably made of metal material, has a substantially plane elongated conformation, extends along the plate 9 on the side opposite to the closing mechanism 3 and has an end hinged to the plate 9 by means of the pin 18.

In particular, the opening lever 30 has, along one side edge thereof, a projection 34, which extends through the slot 28 of the plate 9 and interacts with the projection 27 of the pawl 16. Consequently, the opening lever 30 defines an output member of the mechanical actuating assembly 4.

The opening lever 30 moreover has a portion 35 for interaction with the actuating mechanism 31 and a portion 36 for interacting with the actuating mechanism 32.

The portion 35 is formed by a projection, which extends in cantilever fashion from the plane of the opening lever 30 in a direction opposite to the direction of extension of the projection 34, whilst the portion 36 is formed by an arm, which extends in the same plane from one end of the opening lever 20 opposite to the end of hinging to the pin 18.

The portions 35, 36 originate from opposite side edges of the opening lever 30. More in particular, the portion 36 extends from the same side edge of the opening lever 30 from which the projection 34 extends.

Finally, the opening lever 30 has a through slot 37 of rectangular profile, the function of which will be clarified in what follows, the slot 37 being elongated in the direction of greater extension of the lever 30, i.e., in a direction transverse to the portion 11 of the plate 8.

Figure 6:
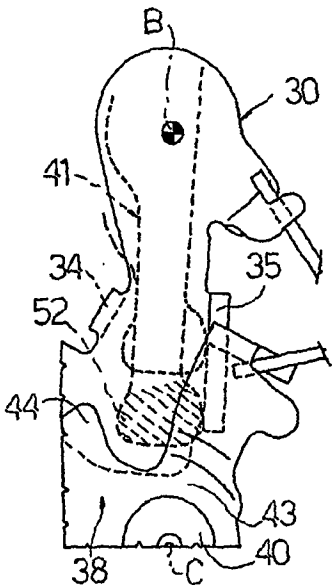
FIG. 6 is a top plan view, in partial cross section and at an enlarged scale, of a further detail of the mechanical actuating assembly illustrated in FIGS. 3 and 4.

The actuating mechanism 31 (FIGS. 1, 4 and 6) comprises an external-control lever 38, which can be connected in a known way (not illustrated) to the external handle of the door and is hinged to the plate 9 around a pin 40 having an axis C parallel to the axes A and B, and a main safety member 41, which can move along the direction of greater extension of the opening lever 30 to provide the external-safety function of the lock 1, i.e., that of inhibition/enabling of the opening of the lock 1 itself by means of the external handle. In particular, the main safety member 41 is mobile with respect to the opening lever 30 between an enabling configuration (external-safety function deactivated, as illustrated in FIG. 6, where part of the main safety member 41 is indicated by an internal dashed line), in which the main safety member 41 is set between the opening lever 30 and the external-control lever 38, thus enabling transmission of motion between the levers 30 and 38 and consequently opening of the lock 1 by means of the external handle, and a disabling configuration (external-safety function activated, as illustrated in FIGS. 4 and 6, where part of the main safety member 41 is without the internal dashed line), in which the main safety member 41 does not enable transmission of motion from the external-control lever 38 to the opening lever 30 and hence inhibits opening of the lock 1 by means of the external handle.

The external-control lever 38, which is conveniently made of metal material, also has an elongated shape and extends on the opposite side of the opening lever 30 with respect to the portion 11 of the plate 8 and with respect to the plate 9, and lies on a plane parallel to the opening lever 30 itself.

The external-control lever 38 is hinged to the plate 9 at one end portion 43 thereof, adjacent to the opening lever 30, and defines, at its own opposite end, a C-shaped seat 42 for attachment to a transmission (not illustrated), for example, of the flexible-cable type, for connection of the lever 38 to the external handle.

In the proximity of its own end portion 43, the external-control lever 38 has a projecting part 44, which, during rotation about the axis C, is designed to set itself partially on top of the slot 37 of the opening lever 30 and to co-operate, via thrust, with the portion 35 of the opening lever 30 by interposition of the main safety member 41 set in the enabling configuration for rotating the opening lever 30 about the axis B.

The opening lever 30 and the external-control lever 38 are normally kept in corresponding positions of rest, in which they co-operate by bearing, respectively, by means of the projection 34, upon an edge of the slot 28 of the plate 9 and, by means of its own side edge, upon a contrast element 45 of the plate 9 from opposite arms 46, 47 of a cylindrical helical spring 48 wound around a projection 49, which protrudes in cantilever fashion from the plate 9 and is set on one side with respect to the levers 30, 38.

The main safety member 41 (FIGS. 1, 4 and 6), which is preferably made of plastic material, has an elongated shape and extends substantially between the external-control lever 38 and the portion 11 of the plate 8 in a direction transverse to the portion 11. The main safety member 41 comprises a plane first portion 50, which extends parallel to the opening lever 30 and on the opposite side of the latter with respect to the plate 9, and a second portion 51, which is substantially L-shaped and has one end 52 slidably engaged within the slot 37 in the direction of greater extension of the opening lever 30. The portion 50 defines, at one end thereof, opposite to the one from which the portion 51 originates, a fixing hole 53 for attachment to the electric-actuator assembly 5, as will be explained in detail in what follows.

With particular reference to FIG. 6, in the enabling configuration, the end 52 of the main safety member 41 engages an end stretch of the slot 37 of the opening lever 30 adjacent to the external-control lever 38 so as to set itself between the projecting part 44 of the external-control lever 38 and the portion 35 of the opening lever 30. Instead, in the disabling configuration, the end 52 of the main safety member 41 engages an opposite end stretch of the slot 37 so as to set itself outside the path of rotation of the projecting part 44 about the axis C and prevent actuation of the opening lever 30 by the projecting part 44 itself.

Figure 5:
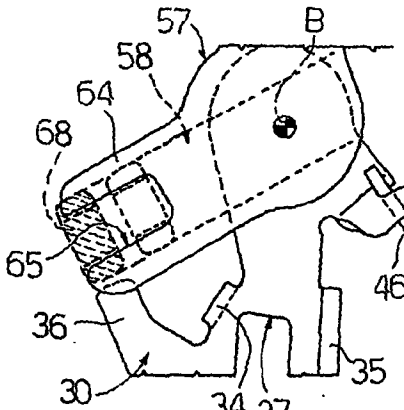
FIG. 5 is a top plan view, in partial cross section and at an enlarged scale, of a detail of the mechanical actuating assembly illustrated in FIGS. 3 and 4.

The actuating mechanism 32 comprises: an internal-control lever 55, which can be connected in a known way (not illustrated) to the internal handle of the door and is hinged to the portion 11 of the plate 8 around a pin 56 having an axis D orthogonal to the portion 11 and to the axes A, B and C; a transmission lever 57, which is hinged to the plate 9 by means of the pin 18, and is actuated by the internal-control lever 55; and an auxiliary safety member 58, which is constrained in a mobile way to the transmission lever 57 and is designed to assume selectively an enabling configuration for opening the lock 1 from inside the motor vehicle (internal-safety function deactivated, as illustrated in FIGS. 1 and 5, where part of the auxiliary safety member 58 is indicated by an internal dashed line), in which the safety member 58 enables transmission of motion by the transmission lever 57 to the opening lever 30, and a disabling configuration for opening of the lock 1 from inside the vehicle (internal-safety function activated, as illustrated in FIGS. 4 and 5, where part of the auxiliary safety member 58 is without the internal dashed line), in which auxiliary the safety member 58 prevents actuation of the opening lever 30 by means of the transmission lever 57.

The internal-control lever 55, which is conveniently made of metal material, also has an L-shaped conformation and extends in a plane of lie orthogonal to the planes of lie of the other components of the mechanical actuating assembly 4.

The internal-control lever 55 has, starting from a portion, in which it is hinged to the pin 56, a first arm 60, which can be connected, at one end, to the internal handle, and a second arm 61, which extends in the direction of the plate 9 and acts via thrust, at one of its ends, on the transmission lever 57.

The transmission lever 57 is preferably made of metal material and substantially extends on a plane parallel to the plate 9, between the opening lever 30 and the main safety member 41 and auxiliary safety member 58. The transmission lever 57 is hinged to the pin 18 at an intermediate portion thereof, from which there extend radially a first arm 62, having an L-shaped notch engaged by the corresponding end of the arm 61 of the internal-control lever 55, and a second arm 64, which is shaped like a fork and defines a seat 65 of slidable constraint for the auxiliary safety member 58.

The transmission lever 57 is subject to a thrust, in a conventional way, from a spring 66 in the direction of a resting position, in which it is set with its own arm 64 immediately upstream of the portion 36 of the opening lever 30 in the direction of rotation of the opening lever 30 itself in order to bring about release of the pawl 16 from the fork 15.

The auxiliary safety member 58, which is conveniently made of plastic material, has a plane elongated conformation and extends in the same direction as the arm 64 of the transmission lever 57 in a position parallel to and set on top of the latter. In particular, the auxiliary safety member 58 is set between the transmission lever 57 and the portion 50 of the main safety member 41. The auxiliary safety member 58 has, at one end thereof, a fixing hole 67 for attachment to the electric-actuator assembly 5, as will be explained in detail in what follows, and, at one opposite end thereof, a projection 68, which is slidably engaged within the seat 65 of the arm 64 and projects, with respect to the arm 64, in the direction of the plate 9.

The auxiliary safety member 58 is thus able to slide along the arm 64 of the transmission lever 57 in order to assume the aforesaid configurations for enabling and disabling opening of the lock 1 from inside the motor vehicle.

More precisely, in the enabling configuration, the projection 68 of the auxiliary safety member 58 engages the outermost stretch of the seat 65, setting itself in contact with the free end of the portion 36 of the opening lever 30 so as to enable rotation of the opening lever 30 about the axis B, as a result of a corresponding rotation of the transmission lever 57 (as illustrated in FIGS. 1 and 5, where the projection 68 is indicated by an internal dashed line). Instead, in the disabling configuration, the projection 68 of the auxiliary safety member 58 engages the innermost stretch of the seat 65 so as not to interact with the portion 36 of the opening lever 30 and thus to prevent actuation of the opening lever 30 itself by the transmission lever 57 (as illustrated in FIGS. 4 and 5, where the projection 68 is without internal dashed line).

According to an important characteristic of the present invention, the electric-actuator assembly 5 (FIGS. 1, 2, 7 and 9) is housed, in a sealed way, in a casing 70 made of plastic material, which can be fixed on the supporting body 6 and comprises a pair of output shafts 71, 72, which traverse, in a sealed way, respective through holes 73, 74 of the casing 70, which have respective eccentric end pins 75, 76, which can be engaged, respectively, with the fixing holes 53, 67 of the main safety member 41 and auxiliary safety member 58 of the mechanical actuating assembly 4.

The casing 70 has a flattened conformation and is made up of a pair of plate-type shells 77, 78 having respective peripheral edges 79, 80 in relief, which have a conformation that is complementary and are coupled together along said edges with interposition of a perimetral sealing gasket 81.

According to a preferred embodiment, the gasket 81 is housed in a corresponding perimetral groove of the shell 77 and is co-moulded on the shell 77 itself.

Figure 7:
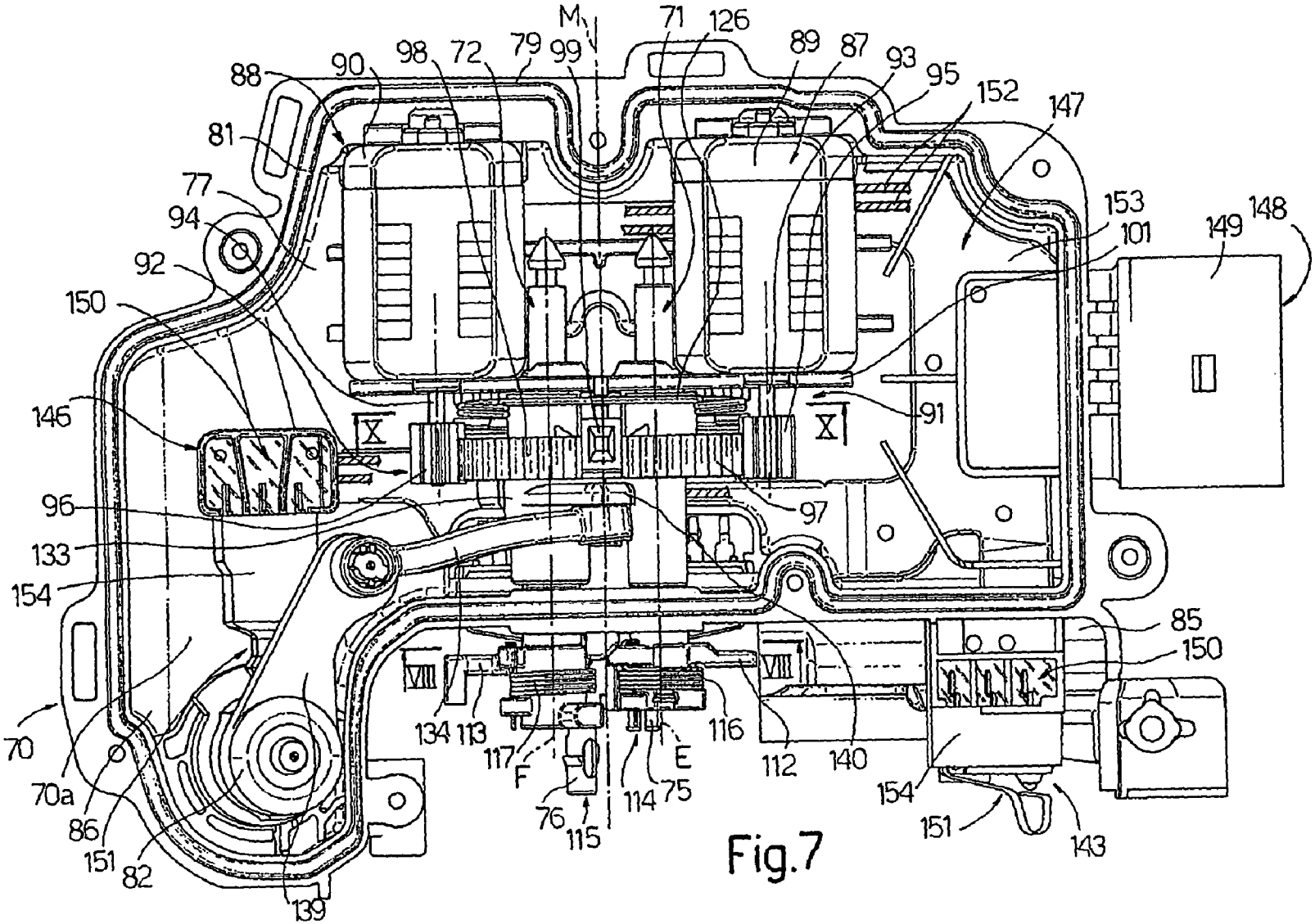
FIG. 7 is a top plan view, at an enlarged scale and with parts removed for reasons of clarity, of an electric-actuator assembly of the lock illustrated in FIG. 1.

As may be seen, in particular, in FIGS. 1 and 7, the casing 70 has, at the opposite sides of the part of the side edges 79, 80 from which the shafts 71, 72 project, respective projections 85, 86. One 85 of said projections 85, 86 is basically represented by a flange, which extends orthogonally, in cantilever fashion, from the shell 77 on the opposite side with respect to the shell 78, whilst the other projection 86 defines a lateral prolongation of the internal cavity of the casing 70 and houses, as will be described in detail hereinafter, a key cylinder 82, which is operatively connected to the electric-actuator assembly 5.

The casing 70 is fixed on the supporting body 6 in the position illustrated in FIGS. 1 and 2, in which the shell 78 is set so that it bears upon the portion 11 of the plate 8, and the projections 85, 86 are set so that they both rest upon the plate 9. More precisely, the projection 85 is fixed, in the same plane, on the area of the plate 9 that covers the fork 15.

The electric-actuator assembly 5 basically comprises a device 87 for controlling the main safety member 41 for activation/deactivation of the external-safety function, i.e., that of inhibition of opening of the door from outside the vehicle, and a device 88 for controlling the auxiliary safety member 58 for activation/deactivation of the internal-safety function (commonly known as "dead lock"), i.e., that of inhibition of opening of the lock 1 from inside the vehicle.

The devices 87, 88 are set inside the casing 70 alongside one another and in a substantially symmetrical position with respect to an intermediate plane M orthogonal to the shells 77, 78, to the portions 10 and 11 of the plate 8, and to the plate 9.

Each device 87, 88 basically comprises an electric motor 89, 90 and a gear-type reducer 91, 92 set between an output shaft 93, 94 of the electric motor 89, 90 and the corresponding shaft 71, 72.

In greater detail, the shafts 71, 72 are set alongside and adjacent to the respective projections 85, 86 of the casing 70 and have axes E, F which are parallel to one another and to the axes A, B and C. The electric motors 89, 90 are set at the opposite sides of the shafts 71, 72 and in a position adjacent to a part of the side edges 79, 80 of the casing 70 opposite to the part from which the shafts 71, 72 protrude.

Each reducer 91, 92 comprises a pinion 95, 96 fixed to the shaft 93, 94 of the corresponding electric motor 89, 90, and a toothed sector 97, 98 fitted on the corresponding shaft 71, 72 and meshing with the pinion 95, 96.

Set between the toothed sectors 97, 98 is a parallelepipedal block 99 made of elastomeric material, which defines an end-of-travel for the toothed sectors 97, 98 themselves.

The shells 77, 78 are provided with a plurality of elements in relief (only some of which are visible in the attached drawings), which delimit respective seats for housing the components of the electric-actuator assembly 5 and have the function of maintaining the aforesaid components in pre-set positions inside the casing 70. In particular, one of said elements in relief, designated by 101, is represented by a flange, which extends orthogonally and in cantilever fashion from an intermediate portion of the shell 77 and which is traversed by the shafts 71, 72. The flange 101 delimits, with corresponding portions of the side edges 79, 80 of the shells 77, 78 facing said flange 101, respective seats for housing the electric motors 89, 90.

Advantageously, the holes 73, 74 are both made entirely in a portion 102 of the side edge 79 of the shell 77 and present, towards the outside of the casing 70, respective stretches having an enlarged cross section for housing corresponding seal rings 103 of the O-ring type (FIGS. 8 and 9).

Each shaft 71, 72 has a first cylindrical end portion 104, 105 set at the side of the corresponding electric motor 89, 90. A prismatic intermediate portion 106, 107 on each of which there is fitted a corresponding sleeve 108, 109 having an internal conformation that is complementary and is provided, on the outside, with the corresponding toothed sector 97, 98, and a second cylindrical opposite end portion 110, 111, which comes out of the casing 70 and is coupled to the corresponding safety member 41, 58 of the mechanical actuating assembly 4.

In particular, the intermediate portion 106, 107 of each shaft 71, 72 extends between the flange 101 and the portion 102 of the side edge 79 of the shell 77.

The end portion 110, 111 of each shaft 71, 72 has an annular shoulder facing the portion 102 of the side edge 79 of the shell 77 and defining an axial contrast element for the corresponding seal ring 103.

The end portions 110, 111 of the shafts 71, 72 are moreover provided with corresponding arms 112, 113, which are substantially radial (the function of which will be clarified in what follows) and extend in the direction of the respective projections 85, 86 in the positions of the shafts 71 and 72 illustrated in FIG. 7, which correspond to the configurations of enabling of the main safety member 41 and the auxiliary safety member 58.

According to a preferred embodiment (FIG. 9), each pin 75, 76 is carried eccentrically and integrally by a corresponding end element 114, 115, which is axially coupled in snap-action fashion on the external end portion 110, 111 of the corresponding shaft 71, 72 so as to be able to rotate freely on an angular segment of the end portion 110, 111, and is subject to the action of return of a corresponding cylindrical helical spring 116, 117 towards a pre-set angular position on the aforesaid end portion 110, 111.

In particular, the end element 114 is formed by a cylindrical pin 118, which engages a blind axial hole made in the end portion 110 of the shaft 71 and is provided with an eccentric enlargement 119, from which there projects in cantilever fashion the pin 75. The end portion 110 is, in turn, provided with an eccentric end projection 120, which defines a contrast element for the enlargement 119 of the end element 114. The axial retention of the end element 114 on the shaft 71 is obtained by means of snap coupling between an angular ribbing made on the enlargement 119 and a complementary groove made in the projection 120. The spring 116 is wound externally around the assembly made up of the end portion 110 and the shaft 71 and by the end element 114, has opposite ends fixed to the enlargement 119 and to the end portion 110 itself, and is designed to maintain the projection 120 and the enlargement 119 so that they bear upon one another.

In a way altogether similar, the end element 115 is formed by a cylindrical sleeve engaged by a pin 123 which projects axially from the end portion 111 of the shaft 72 and terminates with four end tabs designed to couple by snap action on the end element 115 itself in order to withhold it axially on the shaft 72.

The end portion 111 of the shaft 72 and the end element 115 are provided with respective eccentric projections 124, 125, which co-operate by angularly bearing upon one another under the thrust of the spring 117, which is wound around the end element 115 itself. More precisely, the spring 117 has opposite ends fixed, respectively, to the end element 115 and to the end portion 111 of the shaft 72.

Making the end parts of the shafts 71, 72 in two distinct pieces loaded by a corresponding spring 116, 117 in the direction of a pre-set relative angular position enables the manoeuvres of deactivation of the external-safety and internal-safety functions to be carried out even in the presence of temporary impediments due, for example, to the actuation of one of the handles of the door simultaneously with the command for deactivation of the external-safety or the internal-safety function associated thereto.

By way of example, in the case where the external handle is operated and simultaneously a command is sent for deactivation of the external-safety function, i.e., the shaft 71 is rotated about its own axis E to displace the main safety member 41 from the disabling configuration to the enabling configuration, it could occur that the aforesaid displacement of the main safety member 41 cannot be performed on account of the presence of the projecting part 44 of the external control lever 38 in a position corresponding to the slot 37 of the opening lever 30. In this case, the shaft 71 may in any case perform its own rotation, whilst the pin 75 and the main safety member 41 remain stationary and the spring 116 is loaded. As soon as the impediment to sliding of the main safety member 41 ceases, the spring 116 brings the end element 114 back into the initial angular position with respect to the end portion 110 of the shaft 71, and the main safety member 41 reaches the configuration of safety deactivated. In the case of impediments that involve the auxiliary safety member 58 and the corresponding shaft 72, operation is altogether similar and hence is not described here for reasons of brevity.

In practice, the solution described enables uncoupling between each shaft 71, 72 and the corresponding safety member 41, 58 in the presence of any impediment to movement of the said safety member 41, 58 in such a way that the shaft 71, 72 can, in any case, perform its own rotation, and, by means of the action of the corresponding spring 116, 117, makes it possible to complete the movement of the safety member 41, 58 once the impediment ceases.

Figure 10:
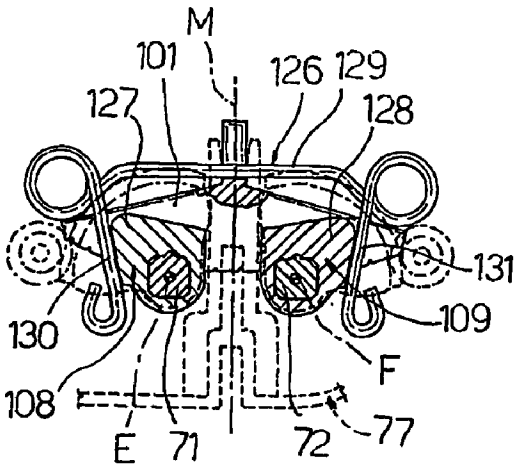
FIGS. 10 and 11 are cross-sectional views according to the line X-X of FIG. 7 in two possible operative configurations of the electric-actuator assembly.
Figure 11:
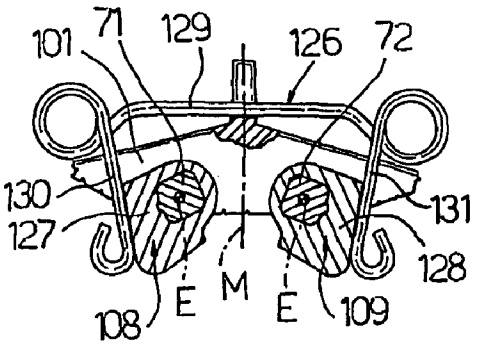

As may be seen in FIGS. 10 and 11, a single spring 126 acts on the sleeves 108, 109 in order to withhold each shaft 71, 72 in two different end-of-travel operating positions, corresponding to the configurations of enabling and disabling of the corresponding safety members 41, 58.

In particular, the spring 126 acts on shaped portions 127, 128 of the sleeves 108, 109, which extend from the respective toothed sectors 97, 98 in the direction of the end portions 104, 105 of the shafts 71, 72.

The spring 126 has a symmetrical conformation with respect to the plane M and consists of a metal wire having a rectilinear intermediate portion 129 fixed to the shell 77 in a position orthogonal to the plane M and above the portions 127, 128 of the sleeves 108, 109, and opposite side branches 130, 131, which are also rectilinear and which extend towards the shell 77 in a direction that is transverse with respect to said shell 77, starting from respective end eyelets of the intermediate portion 129, and act, via compression, on the portions 127, 128 of the respective sleeves 108, 109. More precisely, each branch 130, 131 of the spring 126 acts by compression on one side of the portion 127, 128 of the corresponding sleeve 108, 109 opposite to the one adjacent to the other sleeve 109, 108.

The portion 127, 128 of each sleeve 108, 109 is delimited on one side by two plane faces, which are set at an angle with respect to one another, are joined together by a rounded edge, and interact with the corresponding branch 130, 131 of the spring 126 in order to define the two different operating positions of the corresponding shaft 71, 72.

As may be seen in particular in FIGS. 9, 12, 13 and 14, on one portion 132 of the sleeve 109, set on the opposite side of the toothed sector 98 with respect to the portion 128, there is moreover mounted, in an angularly mobile way, a further sleeve 133, which is connected to the key cylinder 82 by means of a lever 134 and which is provided, in turn, with a toothed sector 135, which meshes with a further toothed sector 136 fixed to the sleeve 108 and hence to the shaft 71.

With particular reference to FIGS. 7, 12, 13 and 14, the key cylinder 82 defines an engagement seat for a control key (neither of which is illustrated) and is mounted in an angularly mobile way through a through hole 138 with edges in relief made in the shell 77 in a position corresponding to the projection 86. The key cylinder 82 is provided with an appendage 139, which is substantially radial and which is hinged to one end of the lever 134, the opposite end of which is hinged to a radial projection 140 of the sleeve 133. Consequently, rotation of the cylinder 82 under the action of the control key brings about a corresponding rotation of the sleeve 133 with respect to the shaft 72 and, by means of meshing between the toothed sectors 135, 136, rotation of the shaft 71 about its own axis E for controlling displacement of the main safety member 41.

Figure 12:
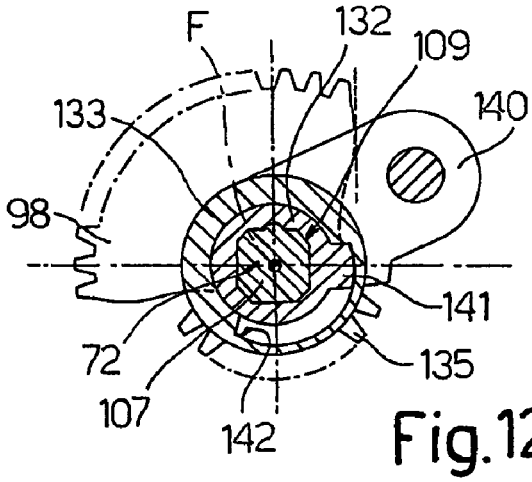
FIGS. 12, 13, and 14 are cross-sectional views according to the line XII-XII of FIG. 9 in three possible operative configurations of the electric-actuator assembly.
Figure 13:
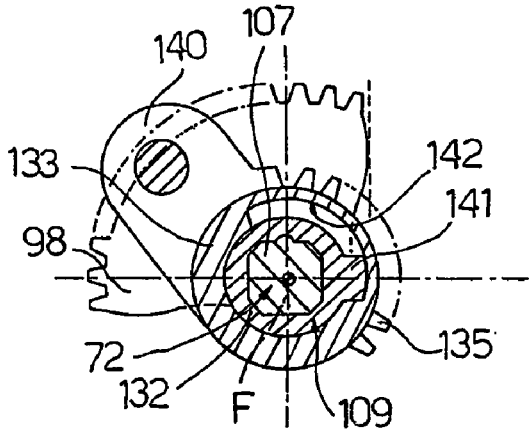
Figure 14:
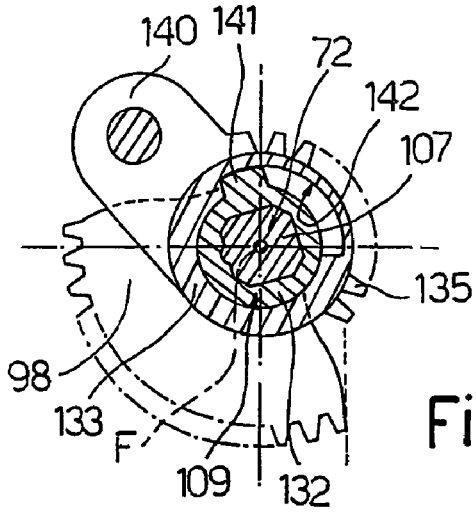

As may be seen in particular in FIGS. 12 to 14, the portion 132 of the sleeve 109 carries externally, in cantilever fashion, a radial tooth 141, which slidably engages with an angular notch 142 made on an internal surface of the sleeve 133.

Engagement between the tooth 141 and the notch 142 has the purpose of enabling activation of the external-safety function, without bringing about the simultaneous activation of the internal-safety function and, vice versa, of bringing about deactivation of the internal-safety function that may possibly be activated each time a command is issued for deactivation of the external-safety function.

FIG. 12 illustrates the relative positions of the sleeves 109 and 133 and of the shaft 72 in the case where the internal-safety and external-safety functions are deactivated. The sleeve 133 can rotate about the axis F in a counterclockwise direction to bring about activation of the external-safety function (FIG. 13), without bringing about rotation of the sleeve 109 and hence of the shaft 72 (the circumferential edge of the notch 142 slides with respect to the tooth 141).

FIG. 14 illustrates the relative positions of the sleeves 109 and 133 and of the shaft 72 in the case where the internal-safety and external-safety functions are activated. The clockwise rotation of the sleeve 133 to bring about deactivation of the external-safety function brings about simultaneous deactivation of the internal-safety function on account of the pull exerted by one of the end radial edges of the notch 142 on the tooth 141.

According to a preferred embodiment of the present invention (FIGS. 7 and 8), the casing 70 carries a plurality of microswitches 143, 144, 145, 146 of a known type, in the case in point four, designed to detect, respectively, the position of the fork 15, the shafts 71, 72 and the key cylinder 82. An electrical circuit 147, which connects the microswitches 143, 144, 145, 146 and the electric motors 89, 90 with an electrical connector 148 is designed to be connected in a known way (not illustrated) to the electrical wiring system of the motor vehicle, and the insulating body 149 of which is integral with the shell 77.

In particular, each microswitch 143, 144, 145, 146 comprises an insulating body 154, which is fixed to the shell 77 within a corresponding housing and from which there projects an electrical-connection means 150 for connection to the electrical circuit 147 and mechanical actuating means 151 designed to co-operate with the member 15, 71, 72, 82, the microswitch 143, 144, 145, 146 of which is to detect the position.

Advantageously, the electrical-connection means 150 of each microswitch 143, 144, 145, 146 are embedded in a resin, indicated schematically by the dashed line in FIG. 7.

In the case illustrated, the microswitches 144, 145 are fixed to the portion 102 of the side edge 79 of the shell 77 and project externally from the shell 77 itself with mechanical actuating means 151 of their own in order to interact with the respective arms 112, 113 of the shafts 71, 72. The microswitch 143 is fixed in a cantilever fashion to the projection 85 of the shell 77 and projects with mechanical actuating means 151 of its own through a through opening (not visible) of the plate 9 in order to interact with the fork 15. The microswitch 146 is, instead, housed entirely within the casing 70 and is fixed to the shell 77 in a position adjacent to the key cylinder 82 so as to be able to interact with the latter.

The electrical circuit 147 comprises a plurality of conductive paths 152 (indicated only partially in FIG. 7), which connect the electric motors 89, 90 and the microswitches 143, 144, 145, 146 to the electrical connector 148 and are carried by a flexible support 153 made of a foil (normally referred to in the sector as "flexfoil") made with insulating material, generally plastic material, and fixed to the shell 77 preferably by means of co-moulding.

Operation of the lock 1 is described starting from the configuration of the closing mechanism 3 illustrated in FIG. 3, in which the lock striker 2 is blocked in the seat 20 of the fork 15 set in the closing position, and the projection 25 of the pawl 16 prevents rotation of the fork 15 itself from the aforesaid position. The configuration described of the closing mechanism 3 can be obtained, in a conventional way, by simply slamming the door.

Opening of the lock 1 from outside the motor vehicle is obtained by acting on the external handle, and hence on the external-control lever 38.

If the external-safety function is deactivated, i.e., the end 52 of the main safety member 41 engages the part of the slot 37 of the opening lever 30 adjacent to the external-control lever 38 (as illustrated in FIG. 6, where the end position 52 is indicated by an internal dashed line), a rotation in a clockwise direction of the external control lever 38 about the axis C causes an action of thrust of the projecting part 44 on the end 52 and of the latter on the portion 35 of the opening lever 30, which is thus rotated in a counterclockwise direction about the pin 18. During rotation of the opening lever 30, the projection 34 intercepts the projection 27 and, via the latter, draws the pawl 16 in the same direction of rotation against the action of the spring 26. In this way, uncoupling of the pawl 16 from the fork 15 is obtained, the fork 15 thus being free to rotate towards its own opening position under the thrust of the spring 23, so as to release the lock striker 2.

If the external-safety function is activated, i.e., the end 52 of the main safety member 41 engages the part of the slot 37 of the opening lever 30 which faces the pin 18 (as illustrated in FIGS. 4 and 6, in which the end position 52 is without the internal dashed line), actuation of the external handle produces an idle displacement of the external-control lever 38.

In fact, during rotation in the clockwise direction of the external-control lever 38 about the axis C, the projecting part 44 cannot intercept the end 52 and terminates its own travel in the proximity of the portion 35 of the opening lever 30, without managing to displace it and hence without managing to bring about release of the pawl 16 from the fork 15.

Opening of the lock 1 from inside the motor vehicle is obtained in a similar way by acting on the internal handle and thus on the internal-control lever 55.

If the internal-safety function is deactivated, i.e., the projection 68 of the auxiliary safety member 58 engages the outermost stretch of the seat 65 of the transmission lever 57 (as illustrated in FIG. 5, in which the position of the projection 68 is indicated by an internal dashed line), a rotation of the internal-control lever 55 in a clockwise direction about the axis D brings about rotation of the transmission lever 57 in a counterclockwise direction about the axis B and the consequent action of thrust of the projection 68 on the portion 36 of the opening lever 30, which is then rotated in the counterclockwise direction about the pin 18, bringing about, in the way described previously, uncoupling of the pawl 16 from the fork 15.

If the internal-safety function is activated, i.e., the projection 68 of the auxiliary safety member 58 engages the innermost stretch of the seat 65 of the transmission lever 57 (as illustrated in FIG. 6, in which the position of the projection 68 is without internal dashed line), the transmission lever 57 undergoes an idle displacement over the top of the opening lever 30, and the projection 68 cannot interact with the portion 36 of the opening lever 30.

Activation of the external-safety function can be obtained by means of a command from the electric motor 89 or by acting on the key cylinder 82.

The electric motor 89, by means of the reducer 91, brings about rotation in a clockwise direction of the sleeve 108 and hence rotation of the shaft 71 from the position illustrated in FIG. 7. The pin 75 thus rotates about the axis E, so bringing about longitudinal translation of the main safety member 41, which is coupled to it, towards the safety-activated configuration.

During rotation of the sleeve 108 about the axis E, the toothed sector 136 draws the toothed sector 135 of the sleeve 133 in rotation with respect to the shaft 72, by rotating, by means of the lever 134, the key cylinder 82 in a counterclockwise direction as viewed in FIG. 7. The circumferential edge of the notch 142 of the sleeve 133 slides with respect to the tooth 141 of the sleeve 109, without causing any action on the shaft 72 and on the auxiliary safety member 58 (FIGS. 12 and 13.

In an altogether similar way, it is possible to obtain activation of the external-safety function by acting on the key cylinder 82.

Activation of the internal-safety function is obtained by activation of the electric motor 90, which, by means of the reducer 92, brings about counterclockwise rotation of the sleeve 109 about the axis F and hence rotation of the shaft 72 and of the pin 76 from the position illustrated in FIG. 7. Rotation of the pin 76 brings about longitudinal translation of the auxiliary safety member 58, which is coupled to it, in the direction of the disabling configuration.

Deactivation of the external-safety and internal-safety functions is obtained simply by rotating the shafts 93, 94 of the respective electric motors 89, 90 in directions opposite to the ones described with regard to activation of the aforesaid functions. As pointed out previously, deactivation of the external-safety function by activation of the electric motor 89 always brings about simultaneous deactivation of the internal-safety function thanks to the action of drawing exerted by the sleeve 133 on the tooth 141 of the sleeve 109 in the clockwise direction of rotation starting from the position of the sleeves 109, 133, as illustrated in FIG. 14.

Figure 15:
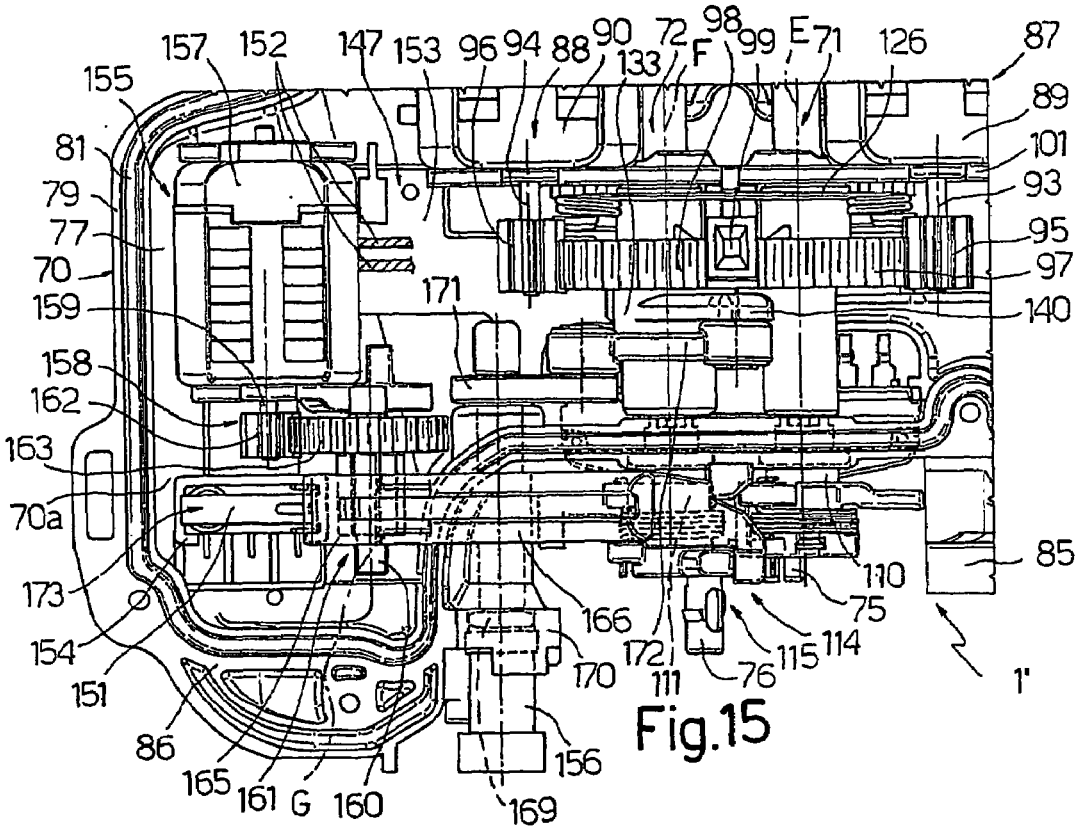
FIG. 15 illustrates, in a top plan view and with parts removed for reasons of clarity, a possible variant of the lock of FIG. 1.
Figure 16:
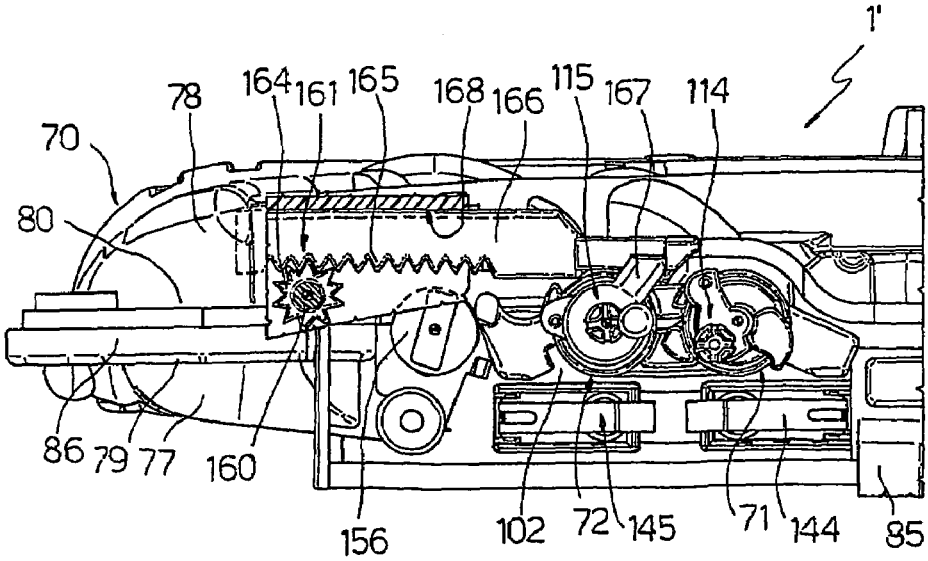
FIG. 16 is a front view, with parts removed for reasons of clarity, of the lock of FIG. 15.

The variant illustrated in FIGS. 15 and 16 regards a lock 1', which is similar to the lock 1 and the constituent parts of which are marked, wherever possible, by the same reference numbers as the corresponding parts of the lock 1 itself.

The lock 1' differs from the lock 1 basically in that the casing 70 houses a further device 155 for controlling the auxiliary safety member 58 for obtaining the so-called "child-safety" function, and a knob 156 for activation/deactivation of the external-safety function instead of the key cylinder 82.

In this connection, it should be remembered that the internal-safety function and the child-safety function, albeit both inhibiting opening of the door from inside the motor vehicle, have completely different purposes. In fact, the internal-safety function is controlled in addition to the external-safety function, when the motor vehicle is left unguarded, with the purpose of preventing fraudulent opening of the lock from outside by means of implements, which may be inserted between the glass of the window and the body of the door and which act on the actuating mechanism 32 from inside. The child-safety function must, instead, be activatable when the motor vehicle is travelling in order to inhibit opening of the door via the internal handle.

The lock 1' is, therefore, suitable for being mounted on a rear door of the vehicle and, if it is equipped just with the knob 156, it could be used for a front door on the passenger side.

The device 155, the knob 156 and the key cylinder 82, when this is present, are housed in one and the same area **70*a* of the casing 70, which is set on the opposite side of the device 88 with respect to the device 87**.

The device 155 comprises an electric motor 157, a gear-type reducer 158 set between an output shaft 159 of the electric motor 157 and a shaft 160 having an axis G parallel to the axes E, F, and a sprocket-rack transmission 161 actuated by the shaft 160 itself and acting on the end element 115 of the shaft 72.

In particular, the reducer 158 comprises a pinion 162, which is fixed to the shaft 159 of the electric motor 157, and a toothed sector 163 fitted on the shaft 160. The transmission 161 comprises a sprocket 164 fitted on the shaft 160 and meshing with a rack 165 made on an end portion of a rod 166, the opposite end portion of which is set outside the casing 70 and is constrained to a radial arm 167 of the end element 115.

As may be seen in FIGS. 15 and 16, the portion of the shaft 160, on which the sprocket 164 is fitted, is housed in a position corresponding to the projection 86, and the rod 166 traverses, with interposition of a sealed ring of the O-ring type (not visible) similar to the seal rings 103, a through hole 168 made in a portion of the side edge 79 of the shell 77, which delimits the projection 86 itself in the direction of the end portions 110, 111 of the shafts 71, 72.

The rack 165 co-operates with a microswitch 173 similar to the microswitches 143, 144, 145, 146, and is also fixed to the shell 77.

The knob 156 is mounted, in such a way that it can turn, and with interposition of a seal ring 169 of the O-ring type, through a cylindrical tubular sleeve 170, which is fixed to the projection 86 of the shell 77 and has, in one end portion thereof, which extends inside the casing 70, a radial appendage 171 hinged to one end of a lever 172, the opposite end of which is hinged to the sleeve 133 in a way altogether similar to that of the lever 134.

In light of the above description, it may be noted that, thanks to the housing of all the electrical components of the lock 1, 1' (electric motors 89, 90, 157, microswitches 143, 144, 145, 146, 173, electrical connector 148, and electric circuit 147) inside a single casing 70, the following advantages may be achieved: the casing 70 can be closed in a fluid-tight way by means of a perimetral gasket 81 and by means of appropriate seal rings 103, 169 set in positions corresponding to the output holes 73, 74, 168, 170 of the interaction members 71, 72, 166, 156 for interaction with the mechanical actuating assembly 4 of the lock 1, 1'; in this way, it is no longer necessary to use relatively costly fluid-tight electrical components; the electric-actuating components 89, 90, 157 and the electrical-sensing components 143, 144, 145, 146, 173 can be easily connected together by means of an electrical circuit 147 housed inside the casing 70; and the insulating body 149 of the connector 148, which connects the electrical circuit 147 to the electrical wiring system of the motor vehicle, can be made of a single piece with the casing 70.

In addition, the lock 1, 1' is highly flexible. In fact, it is possible to provide locks for front doors or rear doors, which implement different functions, using the same casing 70 and the same basic mechanics. In particular, the casing 70 can house, in the same area, the key cylinder 82, which is normally mounted on locks for front doors on the driver's side, or a device 145 for controlling the child-safety function, which is commonly adopted on locks for rear doors, or yet again a knob 156 for manual activation/deactivation of the external-safety function for emergency manoeuvres. The aforesaid devices 82, 155, 156 can be connected to respective attachment means 133, 167 carried by the control member 72 for controlling the internal-safety function.

Finally, it is clear that modifications and variations can be made to the locks 1, 1', without thereby departing from the sphere of protection of the present invention.

The invention claimed is:

1. A lock (1, 1') for a door of a motor vehicle comprising:

a closing mechanism (3) designed for coupling, in a releasable way, with a lock striker (2) for bringing about closing of the door;

a mechanical actuating assembly (4) of said closing mechanism (3), including opening means (30, 38, 55, 57), for controlling release of said closing mechanism (3) from said lock striker (2), and means for inhibiting opening (41, 58), in turn including a first safety member (41) and a second safety member (58), that can be selectively activated for rendering said opening means (30, 38, 55, 57) ineffective, respectively, from outside and from inside the motor vehicle; and electrical actuator means (5) including a first output member (71) coupled with said first safety member (41), said electric-actuator means (5) being housed in a fluid-tight way in a single casing (70) and said first output member (71) traversing, in a fluid-tight way, a through hole (73) of said casing (70) for co-operating with said first safety member (41), and said electric-actuator means (5) including a second output member (72) coupled with said second safety member (58), housed in a fluid-tight way in said casing (70) and traversing in a fluid-tight way a further through hole (74) of said casing (70), and wherein said casing (70) defines an area (70*a*) for housing a manual control device (82, 156) of said first output member (71) and an additional electrical control device (155) of said second output member (72), which provides a function of child safety of said lock (1, 1').

2. The lock as claimed in claim 1, wherein said casing (70) comprises at least two elements (77, 78), which can be coupled together with interposition of first sealing means (81).

3. The lock as claimed in claim 2, wherein said first sealing means (81) includes a gasket (81) co-moulded on a perimetral portion (79) of one (77) of said elements (77, 78).

4. The lock as claimed in claim 3, wherein said holes (73, 74) are made entirely on one (77) of said elements (77, 78) and house respective seal rings (103) co-operating with said output members (71, 72).

5. The lock as claimed in claim 4, wherein each of said first and second safety members (41, 58) interacts with said opening means (30, 38, 55, 57) and is displaceable along a pre-set direction between a disabling configuration, in which it renders said opening means (30, 38, 55, 57) ineffective and an enabling configuration, in which it enables actuation of said closing mechanism (3) by said opening means (30, 38, 55, 57), and in that each of said first and second output members (71, 72) is provided with a rotational motion about an axis (E, F) of its own, which is transverse to the direction of displacement of said first and second safety members (41, 58) and is provided, in a position corresponding to an external end (110, 111) of its own projecting from said casing (70), with a portion (75, 76) for interaction with the relative said safety member (41, 58), said interaction portion (75, 76) being eccentric with respect to said axis (E, F).

6. The lock as claimed in claim 5, wherein said interaction portion (75, 76) is fixed to an end element (114, 115) coupled in an axially fixed position and in an axially mobile way on said external end (110, 111) of the relative said output member (71, 72) and is kept in a pre-set angular position on the external end (110, 111) by elastic means (116, 117).

7. The lock as claimed in claim 6, wherein said interaction portion is a pin (75, 76) engaged with a through hole (53, 67) of the relative said safety member (41, 58).

8. The lock as claimed in claim 7, wherein said opening means includes a first actuating mechanism (31) and a second actuating mechanism (32), which can be connected, respectively, to an external handle and an internal handle of said door for controlling release of said closing mechanism (3) from said lock striker (2) respectively from outside and from inside the motor vehicle, said first and second safety member (41, 58) being respectively available in a corresponding said disabling configuration for rendering the respective said first actuating mechanism (31) and said second actuating mechanism (32) ineffective, providing, respectively, an external-safety function and an internal-safety function.

9. The lock as claimed in claim 8, wherein said first and second output members (71, 72) have parallel axes (E, F) and are actuated by respective electrical control devices (87, 88).

10. The lock as claimed in claim 9, wherein said casing area (70*a*) of said casing (70) is set on one opposite side of said second output member (72) with respect to said first output member (71), and in that said second output member (72) carries a first attachment element (167), which can be connected to said additional electric-control device (155), and a second attachment element (133) which can be connected to said manual-control device (82, 156), said first attachment element (167) being angularly mobile with respect to said second output member (72) and said second attachment element (133) being angularly mobile with respect to said second output member (72) and angularly coupled with said first output member (71).

11. The lock as claimed in claim 10, wherein said casing (70) integrally defines an insulating body (149) of an electrical connector (148) for connection of said electrical actuator means (5) with an electrical wiring system of the motor vehicle.

12. The lock as claimed in claim 11, wherein said casing (70) houses a plurality of warning elements (143, 144, 145, 146, 173) for signalling the operating condition of components of said first lock (1, 1'), and an electrical circuit (147) for connection of said electric-actuator means (5) and said warning elements (143, 144, 145, 146, 173) with said electrical connector (148).

13. The lock as claimed in claim 12, wherein said warning elements comprise a plurality of microswitches (143, 144, 145, 146, 173), each of which has an insulating portion (154) fixed to said casing (70) and electrical-connection means (150) for connection to said electrical circuit (147) projecting from said insulating portion (154) and embedded in a resin.

14. The lock as claimed in claim 13, wherein said electrical circuit (147) comprises a plurality of conductive paths (152) carried by a flexible support made of insulating material (153) fixed to said casing (70).

* * * * *

UNITED STATES PATENT AND TRADEMARK OFFICE

CERTIFICATE OF CORRECTION

PATENT NO. : 7,275,771 B2
APPLICATION NO. : 10/517953
DATED : October 2, 2007
INVENTOR(S) : Crotti et al.

It is certified that error appears in the above-identified patent and that said Letters Patent is hereby corrected as shown below:

In Column 3, line 16: should read,

DETAILED DESCRIPTION OF THE PREFERRED EMBODIMENT

In Column 6, lines 58-59: should read,

...in which <u>the</u> auxiliary [the] safety member 58...

Signed and Sealed this

Fourth Day of December, 2007

JON W. DUDAS
*Director of the United States Patent and Trademark Office*